United States Patent [19]

Collins et al.

[11] 4,360,366

[45] Nov. 23, 1982

[54] LIQUID DISTRIBUTOR FOR A WET ELECTROSTATIC PRECIPITATOR

[75] Inventors: Marvin K. Collins, Mesa; Kenneth F. Blatter, Phoenix, both of Ariz.

[73] Assignee: Dresser Industries, Inc., Dallas, Tex.

[21] Appl. No.: 309,177

[22] Filed: Oct. 7, 1981

[51] Int. Cl.[3] ..... B03C 3/16; B03C 3/53

[52] U.S. Cl. ..... 55/119; 55/122; 261/112; 239/550; 239/566

[58] Field of Search ..... 55/118–120, 55/122, 240, 241; 261/112; 239/550, 551, 566

[56] References Cited

U.S. PATENT DOCUMENTS

| | | | |
|---|---|---|---|
| 3,856,476 | 12/1974 | De Seversky | 55/119 |
| 4,181,509 | 1/1980 | Honacker et al. | 55/122 |
| 4,246,010 | 1/1981 | Honacker | 55/241 |

OTHER PUBLICATIONS

Fluid-Ionic Systems Fluid-Plate ® Modular Wet Precipitator, Field Testing of Prototype Unit Technical Bulletin No. 2, Envirotech Corporation, 7/80.

*Primary Examiner*—David L. Lacey

[57] ABSTRACT

An improved wet electrostatic precipitator (10) includes several flat collector electrodes (12) and flat discharge electrodes (14) respectively arranged between the collector electrodes. Water or another suitable rinse liquid is distributed over the operative surfaces of the collector electrodes by a liquid distribution arrangement comprising several tubular distributor members (60), each member including uniformly spaced, tubular overflow nozzles (62 and 63) that project vertically upwardly and that are individually adjustable to provide for uniform flow. The end overflow nozzles (63) that are adjacent the respective inlets (64) have closed lower ends. Each end nozzle further has a circular inlet aperture or bore (94) in its tubular wall, and each is oriented so that the aperture generally faces toward the associated distributor member inlet. The construction and orientation of the end nozzles assures adequate flow from the turbulent flow region of the distributor members, thereby avoiding dry spots and the resultant sparking that tends to occur at any dry spot.

4 Claims, 5 Drawing Figures

LIQUID DISTRIBUTOR FOR A WET ELECTROSTATIC PRECIPITATOR

BACKGROUND OF THE INVENTION

The present invention generally relates to wet electrostatic precipitators for separating particulates or droplets from a gas stream; and more particularly, this invention concerns an improved liquid distribution arrangement for a wet electrostatic precipitator.

U.S. Pat. No. 4,246,010 to Honacker discloses a wet electrostatic precipitator that includes several coaxially arranged, annular collector plates and several tubular distributor members are respectively arranged above the collector plates. Water or other suitable liquid is pumped into the tubular distributors so that uniform sheets of water are distributed over the surfaces of the collector plates.

Trade literature by the Envirotech Corporation entitled, "Fluid-Ionic Systems Fluid-Plate TM Modular Wet Precipitator", discloses a prototype wet precipitator comprising a rectangular housing, a plurality of generally flat collector plates vertically arranged in the housing, and a plurality of flat discharge electrodes, each being equidistantly spaced between a pair of collector plates. The literature discloses several straight liquid distributor members arranged respectively above the collector plates. The literature indicates that the distributor system uses relatively large discharge ports arranged along the length of the distributor members to provide a smooth and uniform film to completely wet the collecting electrodes with flushing liquid. The design is stated to permit extended operation without plugging.

It is noted that the overflow nozzles are only diagramatically disclosed in the aforementioned trade literature. The precipitators that have heretofore been manufactured and sold by the Fluid-Ionic Systems division of the Envirotech Corporation included annular distributor members having tubular overflow nozzles of constructions that are identical to the nozzles 62 depicted in FIG. 4 hereof—that is, each nozzle is comprised of a threaded cylindrical tube having open lower and upper ends, with the upper end including notches adapted to disrupt any meniscus that may tend to form thereat during operation.

SUMMARY OF THE INVENTION

We have discovered that some liquid distributors for wet electrostatic precipitators do not produce a uniform film of water or other liquid over the surfaces of the collector plates. In particular, those wet precipitators having liquid distributors comprising relatively long tubular distributor members (in a nature of a manifold tube) and several tubular nozzles or nipples which extend vertically upwardly in communication with the liquid in the distributor members have been found to subject to feeding an insufficient amount of liquid from those nozzles that are immediately adjacent the inlet to the distributor members. It is believed that the reduction of flow from the nozzle in the inlet region of the distributor is due to an aspiration effect produced by the turbulent or relatively high velocity water flow from the inlet. The aspiration effect has been noted to sometimes totally interrupt flow regardless of the height of inlet end nozzle. As a result of the reduction or interruption of flow, those portions of the surfaces of the collector plates near the inlet become dry, and substantial sparking occurs at such dry areas.

In accordance with the present invention, an improved liquid distributor for a wet electrostatic precipitator is provided that solves the aforementioned liquid feeding problem. According to the improvement, the improved distributor system includes at least one relatively long distributor member and several tubular nozzles extending vertically upwardly through apertures in the upper end of the distributor member. Liquid is fed to the distributor member and is allowed to develop a controlled relatively constant static pressure within the distributor member. The overflow nozzles are mounted so that flow from the open upper ends of the nozzles is uniform. Those nozzles that are immediately adjacent the liquid inlets of the distributor members have closed bottom ends, and each has an inlet aperture formed in its side near its closed lower end thereof so that such aperture extends into the water contained within the distributor. Each inlet aperture is aligned so that it faces generally toward the associated distributor member inlet, and preferably the inlet aperture is radially oriented at an acute angle relative to the flow of liquid from the inlet. The inlet end overflow nozzle is thereby adapted to turn the velocity pressure of the relatively high velocity liquid in the vicinity thereof into a static pressure that is sufficient to assure that an ample flow of liquid egresses from the nozzle, thus eliminating concern about dry spots on the associated collector plate.

DESCRIPTION OF THE PREFERRED EMBODIMENT

Figure 1:
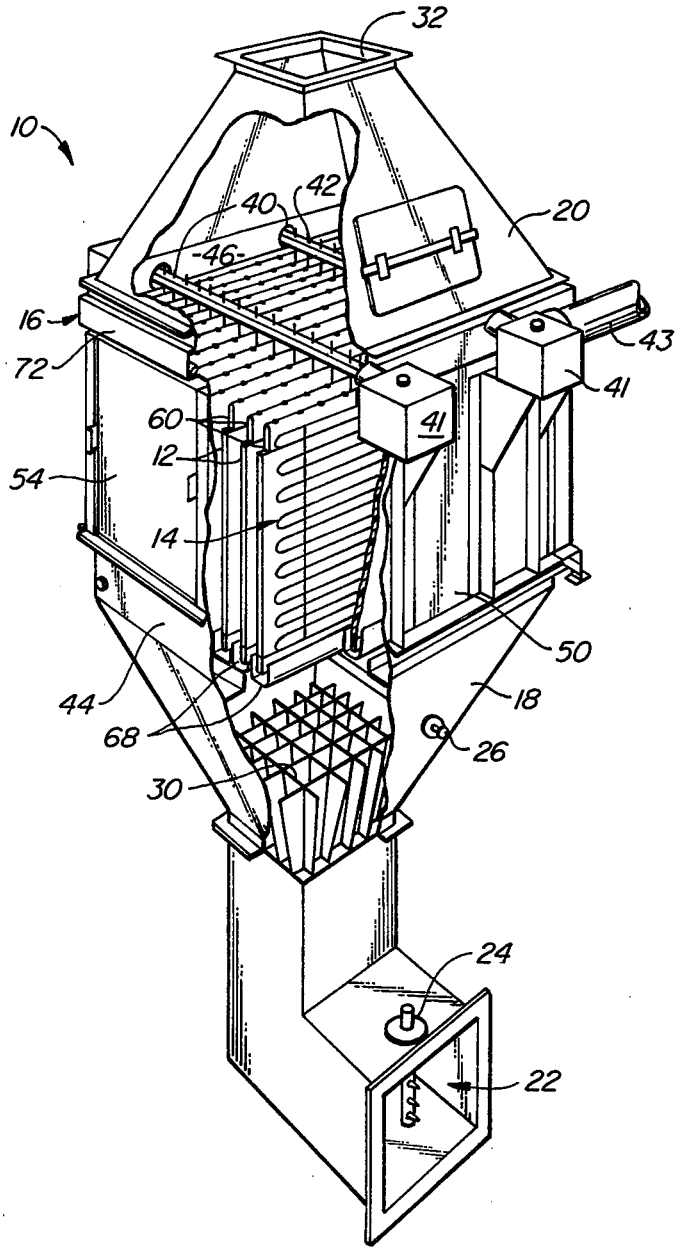
FIG. 1 is a somewhat diagramatic, isometric view of the preferred embodiment of the wet electrostatic precipitator of the present invention, with parts thereof being broken away to illustrate the improved liquid distribution arrangement.

Referring now more particularly to FIG. 1, the preferred embodiment of a wet electrostatic precipitator 10 constructed according to the present invention includes generally flat collector electrodes 12 and flat grid-like discharge electrodes 14. The collector electrodes 12 have flat opposing surfaces that form collector plates (the collector electrodes are hereinafter referred to as collector plates). The collector plates and discharge electrodes are vertically arranged within a rectangular or box-like housing 16. The stream gas to be treated is fed through a diverging, inlet housing portion 18 that is connected to a lower end of the housing 16, and treated gas is discharged through an outlet 32 at the upper end of a discharge hood 20. More particularly, the gas to be treated is fed to the inlet housing portion through an elbow 22. To precondition the gas, a sprayer 24 may be provided adjacent the inlet end of the elbow, and a further sprayer 26 may be provided adjacent the lower or inlet end of the housing 16. The precipitator further includes a straightening vane assembly 30 mounted at the inlet end of the inlet housing portion; the vane assembly streamlines the flow of gas prior to its entering the housing 16.

The discharge electrodes 14 are vertically suspended centrally between the collector plates 12 from horizontal support beams 40. Beams 40 are mounted on insulator structures (not shown) within boxes 41 that are located externally of the housing 16. Each discharge electrode includes a pair of threaded rods 42 (FIG. 1) adapted to extend vertically upwardly through apertures in the support beams, and the rods are bolted to the support beams. A high voltage power supply 43 is operatively connected to one of the support beams to thereby charge the discharge electrodes with a high voltage. It will be seen in FIG. 3 that the discharge electrodes are generally comprised of several electrode wire loops 36 which are vertically spaced along a grid-like frame 38 that includes the aforementioned threaded rods.

Figure 2:
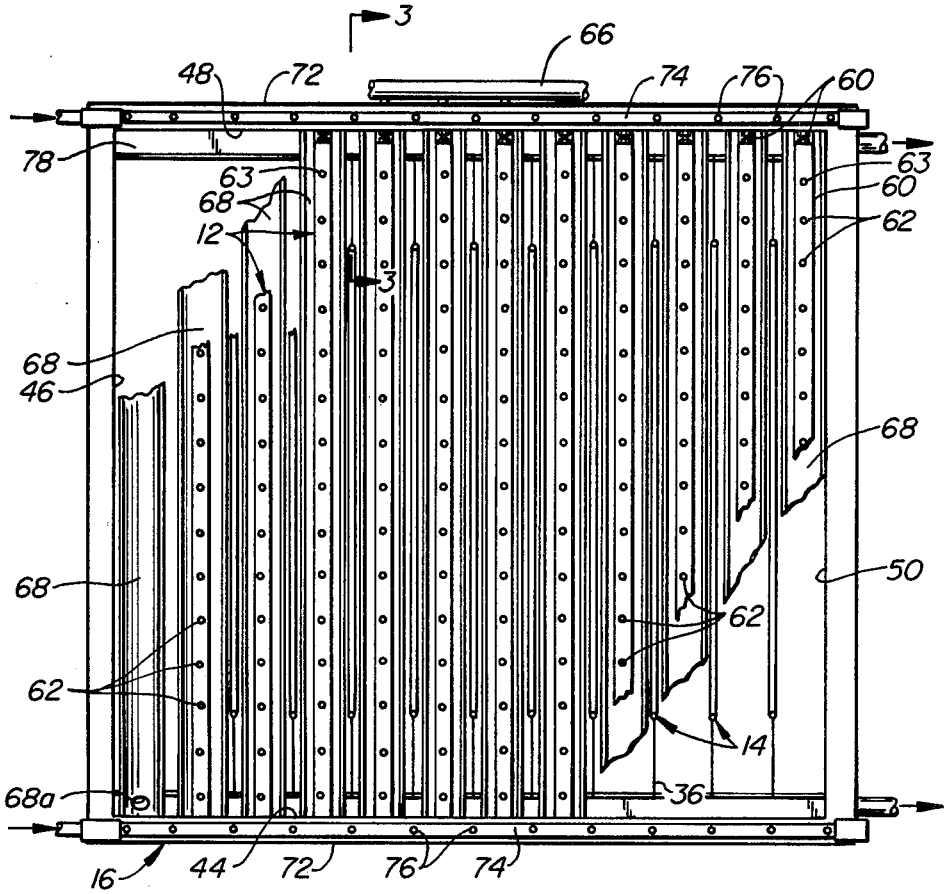
FIG. 2 is a horizontal section taken through the precipitator housing above the distributor members.

The precipitator housing includes a front wall 44 (FIGS. 2 and 3), and a right side wall 50 (FIGS. 1 and 2). A pair of doors 54 are hinged to the front wall 44 to provide access to the interior of the housing 16 so that, for example, the collector plates and electrodes may be removed when desired. The front and rear ends of the collector plates 12 are immediately adjacent the front and rear end walls. Thus, essentially rectangular gas flow passages are formed between adjacent collector plates. Although it is not shown on the drawings, the spaces between the collector plates adjacent to the side walls 46 and 50 are baffled at its lower end to prevent gas from flowing therebetween. Each discharge electrode 14 is centrally (i.e., equidistantly) spaced between the opposing surfaces of the associated collector plates 12.

Figure 3:
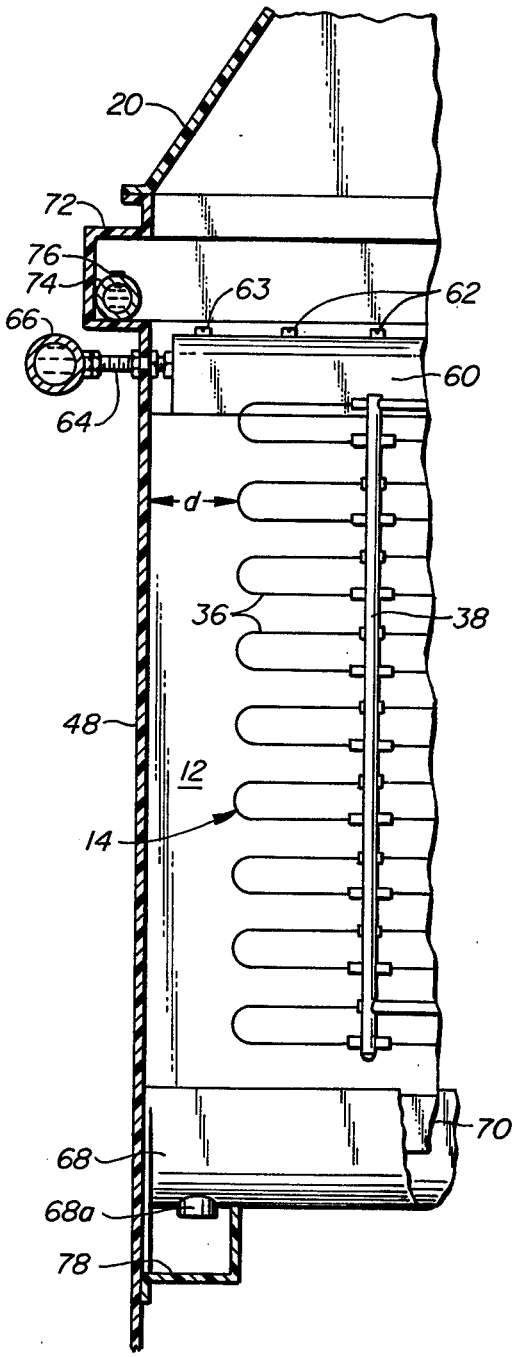
FIG. 3 is a section taken as indicated in FIG. 2.

Referring to FIG. 3, the electrode loops 36 are spaced from the respective front and rear walls by a distance d that is equal to the spacing between the electrode loops and the opposing flat surfaces of the collector plates. The electrode loops are not spaced closer to the front and rear walls than they are to the collector plates so that sparking is avoided between the ends of the loops and the housing walls.

The collector plates 12 are flushed with rinse liquid distributed from tubular distributor tubes or members 60 disposed immediately above each collector plate. Referring to FIG. 3, it will be seen that overflow nozzles 62 and 63 are spaced uniformly along the upper end of the distributor member 60. Water or other suitable liquid is pumped at a controlled pressure to the ends of the distributor members through tubes 64 that are, in turn, connected to a manifold tube 66. The other ends of the distributor members are closed, whereby a controlled static pressure is generated throughout most of the length of the distributor. The water distributed from the nozzles 62 and 63 flows over the upper end of the distributor member and therefrom over the flat collector surfaces on both sides of the collector plates to thereby flush particles or droplets electrostatically attracted to the collector plates. The collector plates are supported on beams 70 and the upper ends of the collector plates are engaged in slots formed in the bottom walls of the tubular distributor members.

The rinse liquid flowing from the collector plates 12 is collected within troughs 68 extending between and connected to the front and rear walls 44 and 48. The troughs 68 are disposed directly below the collector plates and include curved sidewall portions disposed at opposite sides of the support beams 70 for the collector plates. The troughs not only collect the liquid flowing from the plates but also are shaped to streamline the airflow into the rectangular flow passage between the plates. As stated in the aforementioned U.S. Pat. No. 4,246,010 to Honacker, the troughs have venturi-like converging-diverging configurations. The troughs are closed at their ends by bracket walls and have ports **68*a* (FIGS. 2 and 3) located closely adjacent their ends (thus the ports are disposed closely adjacent the front and rear end walls of the housing). Liquid collected from the collector plates flows into the collector troughs and from the collector troughs downwardly through the ports 68*a***.

Liquid is provided to flush the inner surfaces of the front and rear housing walls by a distributor tube 74 mounted on ledges in an outwardly recessed cavities 72 formed in the upper ends of the front and rear housing walls. Nozzles 76 are provided at uniform spacing along the distributor tubes. As with the nozzle 62, nozzles 76 are open at their upper ends to permit liquid to flow upwardly therethrough.

The liquid flowing from the distributor tubes 74 over the inner surfaces of the end walls 44 and 48 is collected within a pair of drain troughs 78 that are respectively mounted to the front and rear housing walls. As may be seen in FIG. 3, troughs 78 project substantially outwardly from the associated housing walls. They project beyond the discharge ports **68*a* in the collector troughs to receive the liquid therefrom. Thus, as may be seen in the plan view of FIG. 2, the drain troughs and collector troughs form a matrix arrangement for collecting liquid from the collector plates 12 and from the end walls 44 and 48**. The collected liquid flows from the drain troughs through a pair of pipes extending from the precipitator.

Figure 4:
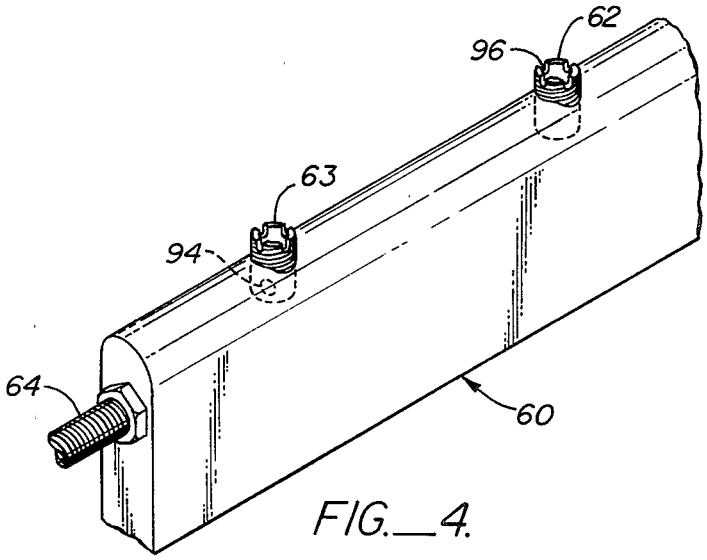
FIG. 4 is an enlarged fragmentary isometric view illustrating the inlet end of the distributor member.
Figure 5:
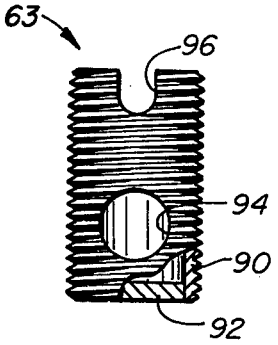
FIG. 5 is a section illustrating the construction of those overflow nozzles that are adjacent the inlets to the distributor members, hereinafter called inlet end nozzles.

The present invention provides an improvement of the liquid distributor system which assures that liquid will be uniformly spread over the surfaces of the collector plates 12 to eliminate any concern about sparking that may be caused by dry spots on the collector surfaces. Referring to FIGS. 3–5, it will be seen that the inlet end overflow nozzle 63 that is adjacent the inlet tube 64 is comprised of a cylindrical tube 90 having a threaded outer surface. The tube 90 is adjustably received in a threaded bore that extends vertically upwardly through the upper end of the distributor members 60. That is, the tubes of the nozzle 63 and the other overflow nozzle 62 extend vertically upwardly and are normal to the curved upper surface of the distributor member (FIG. 4). The end nozzle 63 has a disc or plug 92 affixed in sealed relation in its lower end to thereby form a barrier or plug at the lower end of the threaded tube. A circular inlet aperture or bore 94 is formed in the side wall of the tube at a location adjacent the plug 92. Four semi-circular notches 96 are formed in the upper edge of the tube as illustrated in FIG. 5. It will be noted that similar notches are also formed in the other overflow nozzle 62. The notches serve to break any meniscus that may form at the upper ends of the overflow nozzles.

The other overflow nozzles 62 each include a cylindrical tube which is open at its lower end and are of the same diameter and length as the tubes 90 of the end nozzle 63.

The inlet end overflow nozzles 63 are positioned in their respective threaded apertures in the distributor members 60 so that the inlet apertures 94 thereof generally face toward the respective inlet tubes 64. That is, the inlet apertures in the end nozzles are arranged so that they face counter to the direction of flow in the inlet regions or ends of the distributor members 60. It has been found that if the apertures are arranged so that the center of each aperture is aligned on a radial axis that intersects the direction of flow at an acute angle, that is between 0° and 90°, adequate flow is provided, subject to adjustment of the height of the upper ends of nozzles projecting above the distributor members.

The end nozzles 63 are adapted to convert the velocity pressure produced by the relatively high velocity streams in the inlet regions of the distributors 60 into static energy, which static energy is sufficient to force rinse liquid up through the nozzles and flow with sufficient volumes that are generally equal to the volumes of flow from the other nozzles 62. As previously stated, the prior art liquid distribution systems included only nozzles having a plain cylindrical tube which were open at its lower end, that is, nozzles that were identical to the nozzles 62 shown in FIG. 4. With such construction, it was discovered that it was sometimes impossible (with the static pressure generated in the relatively small tubular distributor member 60) to obtain flow from the nozzles adjacent the inlets, even if such end nozzles were considerably lower (that is, if they were screwed to project more deeply into the distributor member 60) than the other nozzles that were substantially spaced from the inlets. The nozzles 63 constructed in accordance with the present invention are, in contrast, adapted to cause the liquid to be uniformly distributed from all of the nozzles 62 and 63, without increasing the pumping pressure or increasing the size of the distributor members in an effort to augment the static pressure in the inlet regions thereof.

It has also been found that the orientation of the end nozzle 63 (as shown in FIG. 5) relative to the direction of flow is important in obtaining uniformity of flow therefrom. In particular, it has been found that if the endmost overflow nozzle is arranged so that the inlet aperture 94 thereof faces directly away from the associated inlet (that is, in the direction of flow of the liquid in the inlet region), it is sometimes impossible to obtain any flow from the nozzle even at its lowest possible elevation, that is, at an elevation such that the upper end thereof is substantially flush with the upper surface of the distributor member. The preferred radial orientation of each inlet aperture is at a 45° angle from a position directly facing the inlet tube 64.

It is noted that to obtain the desired flow rates from the inlet end overflow nozzles 63, the elevations of such end nozzles are also adjusted. In other words, in addition to adjusting the angles that the inlet apertures 94 form with the direction of flow of the rinse liquid in the inlet regions of the distributor members, the heights of the end nozzles are also adjusted.

Accordingly, the present invention takes into account the discovery that a lack of uniformity of flow from the nozzles at the inlet regions of a distributor member may be caused by an aspiration effect. The present improvement provides a liquid distribution system which assures uniform flow from all of the nozzles by incorporating means in the inlet end overflow nozzles that converts the velocity pressure induced by the relatively turbulent flow in such vicinity into a static pressure which augments the reduced static pressure that is caused by such turbulent flow. The construction and orientation of the end nozzles assure that no dry spots will occur on the surfaces of the plate adjacent the inlet ends of the distributor members, thereby obviating any problems concerning dry spots and the resulting sparking that may occur at such dry spots.

Although the best mode contemplated for carrying out the present invention has been shown and described, it will be apparent that variations and modifications may be made without departing from what is regarded to be the subject matter of the invention.

What is claimed is:

1. In a wet electrostatic precipitator including a housing, a plurality of collector electrodes vertically mounted within the housing, a plurality of discharge electrode assemblies mounted within the housing with one electrode assembly being mounted equidistantly spaced between each pair of the collector electrodes, means adapted for applying a high voltage to the discharge electrode assemblies to form electrostatic fields between the respective pairs of collector electrodes, and a liquid distributor arrangement adapted for flushing the collector electrodes with rinse liquid, said distributor arrangement including a plurality of elongated distributor members, means supporting one of said distributor members directly over each of the collector electrodes, each distributor member being tubular and extending adjacent the top edge of the associated collector electrode and having an inlet opening for providing ingress of rinse liquid, and a plurality of tubular overflow nozzles secured projecting vertically upward at substantially uniform longitudinal spacings in each distributor member, each nozzle having an open upper end located outwardly of the associated distributor member and an inner end located within the associated distributor member, wherein the improvement comprises: the end overflow nozzle of each distributor member located nearest the distributor member inlet opening being closed at its lower inner end and having a flow inlet aperture defined through the tubular wall thereof at a location within the distributor member upwardly displaced from its inner end and being positioned in a directional orientation generally facing toward the inlet opening thereat of the associated distributor member.

2. In a precipitator in accordance with claim 1 wherein said end overflow nozzles are directionally oriented so that the center axis of each flow inlet aperture directionally forms an acute angle with the direction of the distributor member inlet axis thereat.

3. In a precipitator in accordance with claim 2 wherein said end overflow nozzles are oriented so that said acute angle is approximately 45 degrees.

4. In a precipitator according to either claim 2 or claim 3 wherein said inlet apertures are circular shaped.

* * * * *